US006814007B2

(12) United States Patent
Theurer et al.

(10) Patent No.: US 6,814,007 B2
(45) Date of Patent: Nov. 9, 2004

(54) BALLAST TAMPING UNIT

(75) Inventors: Josef Theurer, Vienna (AT); Friedrich Peitl, Linz (AT)

(73) Assignee: Franz Plasser Bahnbaumaschinen-Industriegesellschaft m.b.H., Vienna (AT)

( * ) Notice: Subject to any disclaimer, the term of this patent is extended or adjusted under 35 U.S.C. 154(b) by 0 days.

(21) Appl. No.: 10/436,313

(22) Filed: May 12, 2003

(65) Prior Publication Data

US 2003/0226469 A1 Dec. 11, 2003

(30) Foreign Application Priority Data

Jun. 6, 2002 (AT) ..... GM 362/2002

(51) Int. Cl.[7] ..... E01B 27/00
(52) U.S. Cl. ..... 104/12
(58) Field of Search ..... 104/2, 10, 11, 104/12

(56) References Cited

U.S. PATENT DOCUMENTS 4,576,095 A 3/1986 Theurer
5,133,263 A * 7/1992 Theurer ..... 104/12
5,706,734 A * 1/1998 Theuerer ..... 104/12

* cited by examiner

*Primary Examiner*—S. Joseph Morano
*Assistant Examiner*—Robert J. McCarry, Jr.

(74) *Attorney, Agent, or Firm*—Collard & Roe, P.C.

(57) ABSTRACT

Adaptation to varying distances between successive ties is facilitated with a ballast tamping unit for tamping ballast under successive ties of a railroad track, which comprises a frame extending in a longitudinal direction, and tamping tool arms mounted on the frame for pivoting about an axis extending perpendicularly to the longitudinal direction, the tamping tool arms having at least one recess at a lower end thereof for receiving and affixing a tamping pick arranged to be immersed in the ballast between two adjacent ties, and at least one of the tamping tool arms having two such recesses arranged successively in the longitudinal direction for selectively receiving and affixing the tamping pick. A reciprocating drive is connected to an upper end of each tamping tool arm for pivoting the tamping tool arm about the axis in the longitudinal direction.

3 Claims, 1 Drawing Sheet

BALLAST TAMPING UNIT

BACKGROUND OF THE INVENTION

1. Field of the Invention

The present invention relates to a ballast tamping unit for tamping ballast under successive ties of a railroad track, which comprises a frame extending in a longitudinal direction, tamping tool arms mounted on the frame for pivoting about an axis extending perpendicularly to the longitudinal direction, the tamping tool arms having at least one recess at a lower end thereof for receiving and affixing a tamping pick arranged to be immersed in the ballast between two adjacent ties, and a reciprocating drive connected to an upper end of each tamping tool arm for pivoting the tamping tool arm about the axis in the longitudinal direction.

2. Description of the Prior Art

U.S. Pat. No. 4,576,095 discloses a ballast tamping unit of this type, in which the distance between the two tamping tools of a pair of tamping tools reciprocable with respect to each other may be varied. This is necessary particularly when a double tie at a rail joint is to be tamped. To make such a change in the opening width for the tamping tool reciprocation possible, a stop pivotal into engagement with the piston rod of the reciprocating drive may be actuated to change the reciprocating path and thus the opening width. This makes it also possible to make adjustments for varying distances between adjacent ties.

In the tamping of railroad track ties, in which reciprocating tamping picks are immersed in the ballast between adjacent ties, the mutual distance between the successive ties is of great importance. When these distances change in a railroad track, for instance because of a change from wooden to concrete ties, serious problems arise during the ballast tamping operation. Normally, such a change requires the use of another ballast tamping tool unit whose tamping picks are adjusted to the changed distance.

SUMMARY OF THE INVENTION

It is the primary object of this invention to provide a ballast tamping unit of the first-described type which simplifies the adaptation to different distances between adjacent ties.

This and other objects are obtained in such a ballast tamping unit when at least one of the tamping tool arms has two of the recesses arranged successively in the longitudinal direction for selectively receiving and affixing the tamping pick.

This simple structural change enables the ballast tamping unit to be retrofitted in a minimum time by removing the tamping pick from one recess and affixing it to the other one of the two recesses in the tamping tool arm. This makes the adaptation to the changed distance between adjacent ties easy. It is particularly advantageous because it enables two railroad track sections with different ties to be tamped without any problem in a single operating pass with the same ballast tamping unit.

BRIEF DESCRIPTION OF THE DRAWING

The above and other objects, advantages and features of the invention will become more apparent from the following detailed description of certain now preferred embodiments thereof, taken in conjunction with the accompanying drawing wherein.

DETAILED DESCRIPTION OF THE PREFERRED EMBODIMENTS

Figure 1:
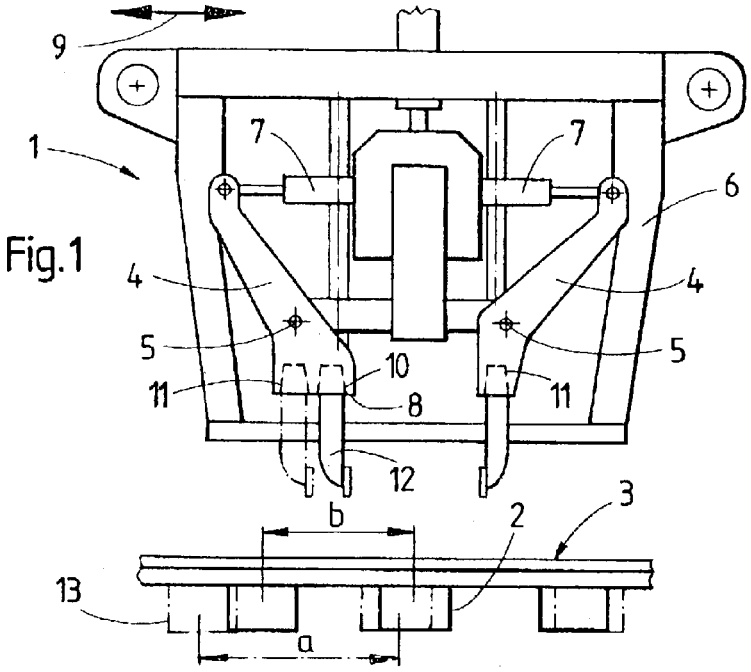
FIG. 1 is a side elevational view of a ballast tamping unit for tamping a single tie, according to the present invention.

To simplify the description, the same reference numerals are used throughout the drawing to designate like parts functioning in a like manner.

Referring to the drawing and first to FIG. 1, there is shown a ballast tamping unit 1 for tamping ballast under successive ties 2 of railroad track 3. The ballast tamping unit comprises frame 6 extending in a longitudinal direction indicated by double-headed arrow 9. Tamping tool arms 4 are mounted on frame 6 for pivoting about axis 5 extending perpendicularly to the longitudinal direction. In the illustrated embodiment, one tamping tool arm 4 has one recess 11 at lower end 8 thereof for receiving and affixing a tamping pick 12 arranged to be immersed in the ballast between two adjacent ties 2, while the other tamping tool arm 4, according to this invention, has two recesses 10, 11 arranged successively in the longitudinal direction for selectively receiving and affixing tamping pick 12. A reciprocating drive 7 is connected to an upper end of each tamping tool arm 4 for pivoting the tamping tool arm about axis 5 in the longitudinal direction indicated by arrow 9.

Phantom lines 13 indicate concrete ties defining a wider distance a therebetween, in which case tamping pick 12 (also shown in phantom lines) is affixed to recess 11 of other tamping tool arm 4. When there is a change from concrete to wooden ties (shown in solid lines), the tamping pick is detached from recess 11 and affixed to recess 10 (as shown in solid lines), thus reducing the opening width of the reciprocating tamping tool arms 4, 4 to adapt to reduced distance b between adjacent ties 2.

Figure 2:
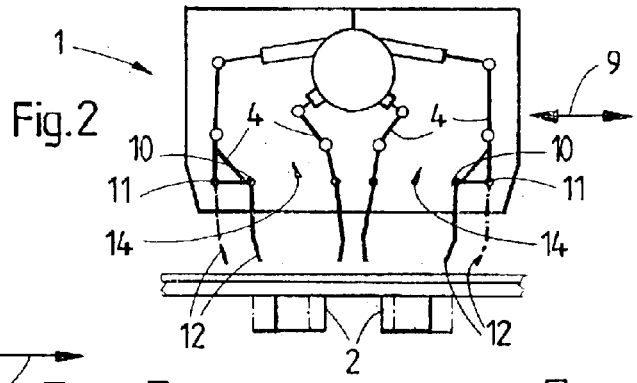
FIGS. 2 to 4 are schematic side views of of such a ballast tamping unit for tamping two or three ties simultaneoulsy.

In the embodiment of FIG. 2, ballast tamping unit 1 comprises two pairs 14 of tamping tool arms 4 pivotally mounted on frame 6. The two pairs 14 are spaced from each other in the longitudinal direction and the tamping tool arms of each pair 14 are reciprocable in the longitudinal direction. Such ballast tamping units for simultaneously tamping two ties are well known. In this embodiment, only the outermost tamping tool arms 4 in the longitudinal direction have two recesses 10, 11 for selectively receiving and affixing tamping picks 12, as indicated in solid and phantom lines. The inner tamping tool arms have only one recess.

Figure 3:
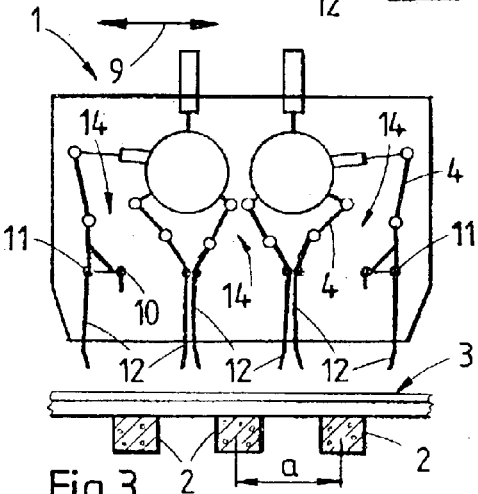
Figure 4:
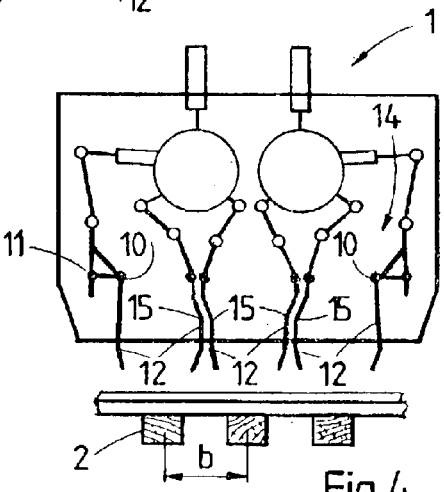

The embodiments illustrated in FIGS. 3 and 4 are designed for the simulteneous tamping of three ties 2, and such ballast tamping units are also well known. As shown, ballast tamping unit 1 of these embodiments comprises three pairs 14 spaced from each other in the longitudinal direction, and tamping tool arms 4 of each pair 14 are reciprocable in the longitudinal direction. Only the outermost tamping tool arms 4 in the longitudinal direction have two recesses 10, 11 for selectively receiving and affixing tamping picks 12. The inner tamping tool arms have only one recess.

As shown in FIG. 4, adaptation to a smaller distance between adjacent ties is obtained by moving tamping picks 12 from recesses 11 in outermost tamping tool arms 4 to recesses 10 while the tamping tool arms positioned between the outermost tamping tool arms have tamping picks 12 affixed thereto which have portions 15 offset relative to each other along the length thereof. This enables the reciprocation of the inner tamping tool arms in the narrow space available to proceed without problems.

What is claimed is:

1. A ballast tamping unit for tamping ballast under successive ties of a railroad track, which comprises (a) a frame extending in a longitudinal direction, (b) tamping tool arms mounted on the frame for pivoting about an axis extending perpendicularly to the longitudinal direction, the tamping tool arms having at least one recess at a lower end thereof for receiving and affixing a tamping pick arranged to be immersed in the ballast between two adjacent ties, and at least one of the tamping tool arms having two of said recesses arranged successively in the longitudinal direction for selectively receiving and affixing the tamping pick, and (c) a reciprocating drive connected to an upper end of each tamping tool arm for pivoting the tamping tool arm about the axis in the longitudinal direction.

2. The ballast tamping unit of claim 1, comprising two pairs of said tamping tool arms pivotally mounted on the frame, the two pairs being spaced from each other in the longitudinal direction and the tamping tool arms of each pair being reciprocable in the longitudinal direction, and only the outermost tamping tool arms in the longitudinal direction having the two recesses.

3. The ballast tamping unit of claim 2, wherein the tamping tool arms positioned between the outermost tamping tool arms have tamping picks affixed thereto which have portions offset relative to each other along the length thereof.

* * * * *